US006409637B1

(12) United States Patent
Webber et al.

(10) Patent No.: US 6,409,637 B1
(45) Date of Patent: Jun. 25, 2002

(54) WEIGHT STACK FRAME

(75) Inventors: Randall T. Webber, San Diego; George M. Zink, Escondido, both of CA (US)

(73) Assignee: Hoist Fitness Systems, San Diego, CA (US)

( * ) Notice: Subject to any disclaimer, the term of this patent is extended or adjusted under 35 U.S.C. 154(b) by 0 days.

(21) Appl. No.: 09/448,075

(22) Filed: Nov. 23, 1999

(51) Int. Cl.[7] ..... A63B 21/062
(52) U.S. Cl. ..... 482/99; 482/100; 482/137
(58) Field of Search ..... 482/98–103, 133–138

(56) References Cited

U.S. PATENT DOCUMENTS

| | | | | |
|---|---|---|---|---|
| 4,240,626 A | * | 12/1980 | Lambert, Jr. | 482/100 |
| 4,600,189 A | | 7/1986 | Olschansky et al. | |
| 4,609,189 A | * | 9/1986 | Brasher | 482/102 |
| 4,697,809 A | * | 10/1987 | Rockwell | 482/102 |
| 4,911,435 A | * | 3/1990 | Johns | 482/137 |
| D330,238 S | | 10/1992 | Desiderio | |
| 5,322,489 A | | 6/1994 | Webb et al. | |
| D357,957 S | * | 5/1995 | Hung | D21/676 |
| D358,183 S | | 5/1995 | Habing et al. | |
| 5,437,589 A | | 8/1995 | Habing | |
| 5,447,480 A | | 9/1995 | Fulks | |
| 5,549,530 A | | 8/1996 | Fulks | |
| 5,580,341 A | | 12/1996 | Simonson | |
| 5,620,402 A | * | 4/1997 | Simonson | 482/100 |
| 5,624,353 A | | 4/1997 | Naidus | |
| 5,931,767 A | | 8/1999 | Morales | |
| D420,073 S | | 2/2000 | Alessandri | |
| D437,370 S | | 2/2001 | Webber et al. | |
| D438,267 S | | 2/2001 | Webber et al. | |

OTHER PUBLICATIONS

Universal Centurian DVR Pullover Machine No. 9879, Universal Physical Conditioning Equipment 1985 Catalog, p. 22, 1985.*
Muscle Dynamics "Mexicam" brochure, early 1990's.
Cybex Arm Curl, Overhead Press, Leg Extension and Prone Leg Curl, Brochure, 1995.
Life Fitness brochure, 1997.
Icarian 204 Camber Curl, 500 Shoulder Press, 605 Leg Extension, Brochure, late 1990's.
Hoist Fitness Systems, Leg Extension and Low Back Machines, late 1980's.

* cited by examiner

*Primary Examiner*—Jerome W. Donnelly
*Assistant Examiner*—Victor K. Hwang
(74) *Attorney, Agent, or Firm*—Brown, Martin, Haller & McClain, LLP

(57) ABSTRACT

A weight stack frame for supporting the weight stack of an exercise machine is designed for positioning alongside a seat and exercise device. The frame has spaced upper and lower struts, and front and rear upright struts extending between the front ends and the rear ends, respectively, of the upper and lower struts to form an enclosed frame. Each upright strut is inclined forwardly at a predetermined angle, and the frame can have a load transfer cam mounted either on the front or rear strut for transferring load to the exercise device alongside the frame.

36 Claims, 8 Drawing Sheets

WEIGHT STACK FRAME

BACKGROUND OF THE INVENTION

The present invention relates generally to weight lifting exercise machines, and is particularly concerned with a weight stack frame for mounting a weight stack for linking to exercise equipment on an exercise machine.

Traditionally, weight stacks for exercise machines are mounted in one of two ways, either in-line with the weight stack located either directly in front or directly behind the user, or offset, with the weights located to one side of the user. Exercise machines with in-line weight stacks generally have a footprint that is long and narrow, while machines with an offset weight stack are wider but not as deep. With either design, the footprint should cover as small an area as possible, as square footage is usually at a premium either in a fitness facility or in a home gym environment. If a machine is small, more machines can fit onto the floor space of an exercise facility, and more users can exercise at the same time.

The main advantage to offset weight stacks is the ease of adjusting the weights from the user position. Generally, the user must only reach to the side in order to select the appropriate amount of weight to be lifted. This is true whether the user is performing standing or seated exercises. This is not true of machines with in-line weight stacks. When the weights are mounted in-line and behind the exercise position, the user must reach around to adjust the weights. If seated, the user must get up and walk to the side of the machine in order to adjust the weights. This is inconvenient, and can be a problem in commercial installations such as health clubs, community centers, or the like, where members must wait their turn while the current user is constantly getting up to adjust the weights. For this reason, most commercial exercise machines manufactured today have offset weight stacks.

Weight stacks that are mounted to the side of the user are traditionally belt or cable-driven, and have a cam that the belt or cable wraps around during the exercise movement. The cam is attached to one end of a pivot shaft, and the exercise arm is attached to the opposite end of the shaft. Thus, the cam transfers load or resistance from the weight stack to the exercise arm. The cam is generally mounted on the weight stack frame.

Weight stack frames of various shapes and sizes have been designed in the past. The most common weight stack frame has a pair of straight, vertical and parallel upright struts, and parallel horizontal top and bottom struts to capture the weight stack guide rods on which the weights travel up and down. Another relatively common design is the "A" frame, with uprights that angle downward and outward from the top strut at opposing angles.

Generally, pulleys guide the weight stack cable from the top strut of the weight stack frame to the cam. The pulleys are generally mounted in a housing attached either to the top or bottom side of the top strut. In some cases, the pulley housing protrudes from the frame and has one end suspended in mid-air, in order to guide the cable in front of the frame and onto the cam. This places a strain on the welds attaching the housing to the frame, and detracts from the smooth appearance of the frame. Mounting the housing underneath the top strut of the frame also has disadvantages, since any applied force will be transferred to the welds securing the housing to the frame, potentially causing the housing to tear or break away from the strut.

SUMMARY OF THE INVENTION

It is an object of the present invention to provide a new and improved weight stack frame which provides for more convenient mounting of the cam.

It is another object of the present invention to provide a weight stack frame with a new and improved pulley housing arrangement.

According to one aspect of the present invention, a weight stack frame for supporting the weight stack of an exercise machine is provided, which comprises a lower horizontal strut, an upper horizontal strut, and front and rear upright struts extending between the upper and lower struts, the upright struts being inclined forwardly at a predetermined angle. The upright struts are preferably parallel to one another.

This provides an angled, forwardly inclined weight stack frame, which permits a cam for transferring load from the weight stack to an exercise station to be located at a more advantageous position on the frame, closer to the frame, so that less stress is placed on the cam mount. The forwardly inclined weight stack frame also provides for the maximum amount of weight stack travel while still having only a relatively small footprint. The frame can accommodate either a forward or rearward mounted cam or exercise arm attachment without needing to reverse the frame.

The frame may be inclined at various angles, although an angle of between 5 and 10 degrees to the vertical is preferred. Preferably, the angled upright struts curve inwardly at their upper ends to join the top strut. A pulley housing may be mounted on the top strut in order to house pulleys for guiding the load-carrying belt or cable to the front or rear of the frame. The housing has first and second ends and a first pulley is located in the first end of the housing at a position above the center of the weight stack, while a second pulley is located at the second end of the housing at a position protruding slightly outwardly from the respective upright strut at the front or rear of the housing. Preferably, the second pulley is at a lower elevation than the first pulley. This arrangement permits the load-carrying belt or cable to be easily directed to the front or rear of the frame, and to the cam mounted on the front or rear upright.

According to another aspect of the present invention, a weight stack frame apparatus is provided, which comprises a frame having upper and lower struts and front and rear upright struts extending between the upper and lower struts, a mounting and guide assembly for a weight stack extending between the upper and lower struts, the upper strut having an upper side, a lower side, a front end and a rear end, and a pulley housing mounted on the upper side of the upper strut, the pulley housing having a first end located over the weight stack mounting and guide assembly and a second end projecting slightly over one end of the upper strut, a first pulley mounted in the first end of the housing, and a second pulley mounted in the second end of the housing, the pulleys comprising means for guiding a load-bearing cable from the weight stack to the front or rear end of the housing.

The pulley housing will be directed forwardly for exercise machines with forward mounted exercise arms, and will be directed rearwardly for exercise machines having rearward mounted exercise arms or devices. In each case, a cam for transferring load to the exercise arm will be mounted on the respective front or rear upright strut, and the load-carrying belt or cable will be directed from the second pulley to the cam, with the belt running as close as possible to the weight stack frame. This reduces the risk of users accidentally coming into contact with the load-carrying belt or cable. The cam may be located directly below the second pulley, or a guide pulley may be mounted on the upright strut for directing the cable or belt from a location directly below the second pulley outwardly to the cam.

Preferably, the pulley housing angles downward from the first end to the second end, to allow the second pulley to rest more closely in the radius of a bend in the frame where the upright strut joins the top strut. This provides a more aesthetically pleasing appearance, as well as keeping the load-carrying belt or cable as close as possible to the frame, and providing good structural support for the housing on the frame, since the housing does not have any portions projecting outwardly from the frame. The closer the belt or cable runs to the frame, the less likely it will be to come into contact with a user or bystander. This is an extremely important safety consideration in unsupervised situations.

In a preferred embodiment of the invention, the pulley housing has spaced side walls and a top wall enclosing the pulleys and load-carrying cable or belt. The top wall provides a safety barrier between the belt and any bystander, and also acts as a guard to reduce the risk of the belt or cable jumping off the pulleys as a result of sudden movement of the exercise arm.

According to another aspect of the present invention, an exercise machine is provided which comprises an exercise arm support frame, an exercise arm pivotally mounted on the exercise arm support frame, a forwardly facing seat for a user using the exercise arm to perform exercises, a weight stack support frame positioned to one side of the seat, the frame having a lower strut, an upper strut, and front and rear struts extending between the lower and upper struts to form an enclosure, a weight stack mounted in the frame enclosure, and a cable and pulley assembly linking a preselected number of weights in the weight stack to the exercise arm, the front and rear struts of the weight stack frame being parallel to one another and being inclined forwardly at an angle to the vertical orientation.

The forwardly inclined weight stack frame of this invention is an improvement over conventional vertical frames or A-frames, in that it allows a more advantageous cam or exercise arm attachment position, closer to the frame, and does not require the frame to be reversed for a rear cam mount. It may also reduce the footprint, or floor area, required to accommodate the exercise machine. The weight stack frame incorporating an angled pulley housing on top of the upper strut permits the load bearing cable or belt to run closer to the frame, reducing the risk of injury as a result of a user or bystander coming into contact with the cable or belt.

BRIEF DESCRIPTION OF THE DRAWINGS

The present invention will be better understood from the following detailed description of some preferred embodiments of the invention, taken in conjunction with the accompanying drawings in which like reference numerals refer to like parts and in which.

DESCRIPTION OF THE PREFERRED EMBODIMENTS

Figure 2:
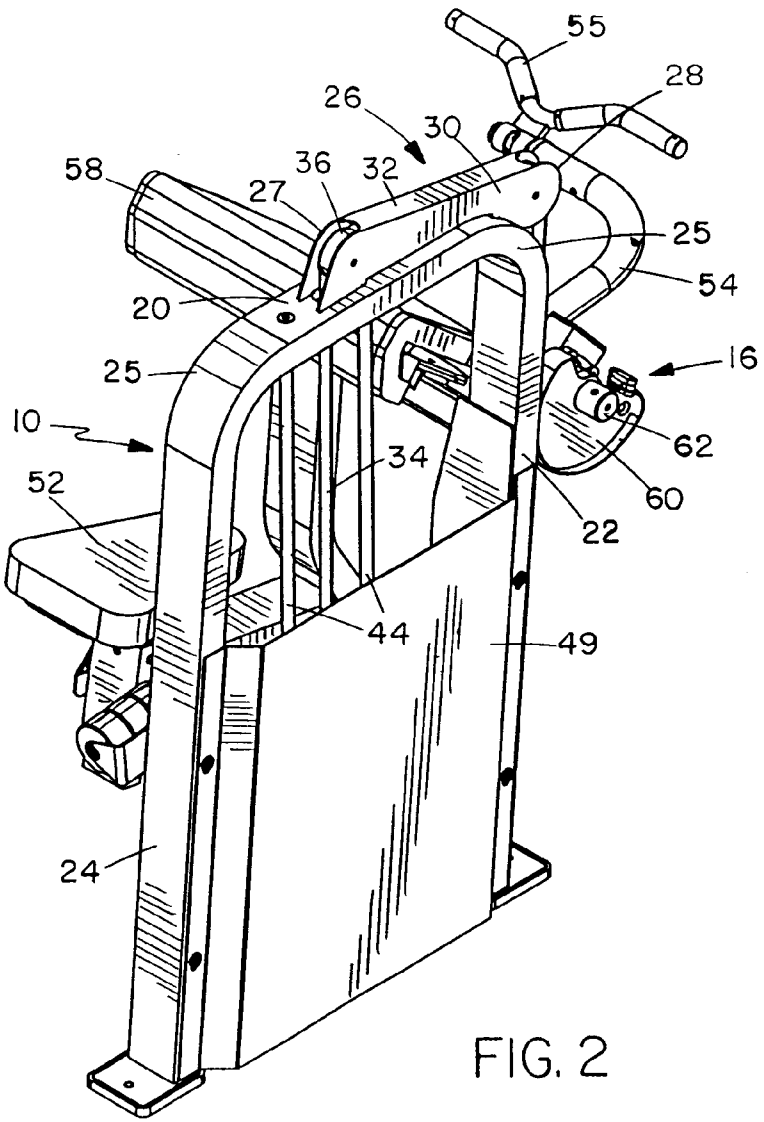
FIG. 2 is a rear perspective view of the machine of FIG. 1.
Figure 1:
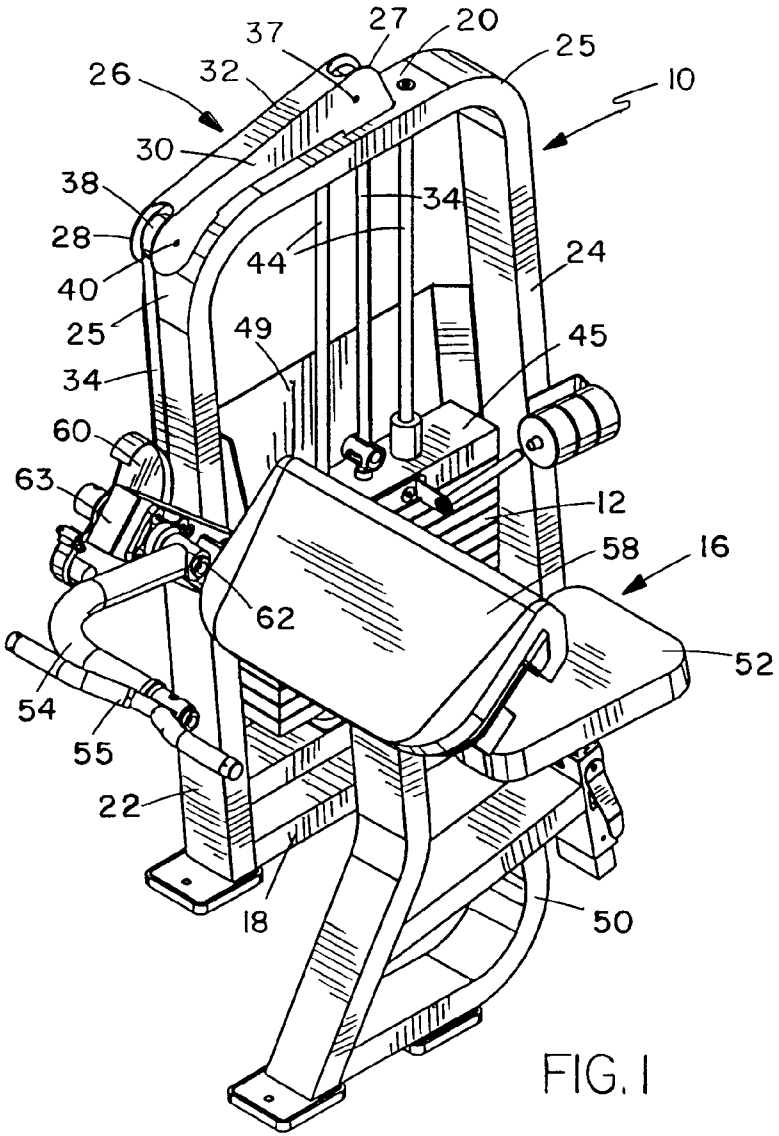
FIG. 1 is a front perspective view of a bicep curl exercise machine incorporating a weight stack frame according to a first embodiment of the present invention.
Figure 3:
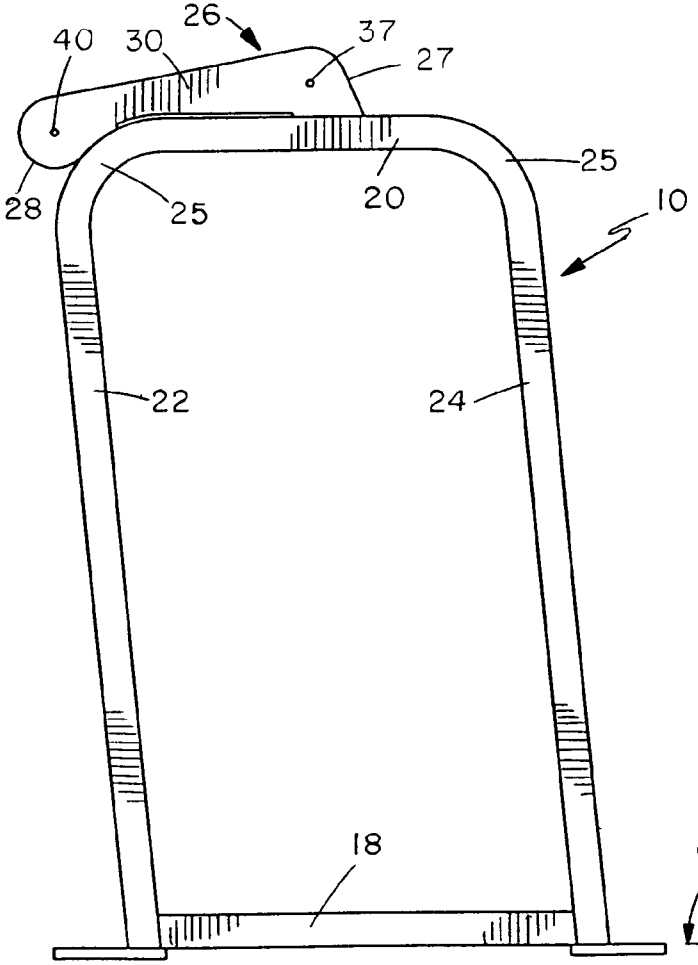
FIG. 3 is a right hand side view of the weight stack frame of FIGS. 1 and 2.
Figure 11:
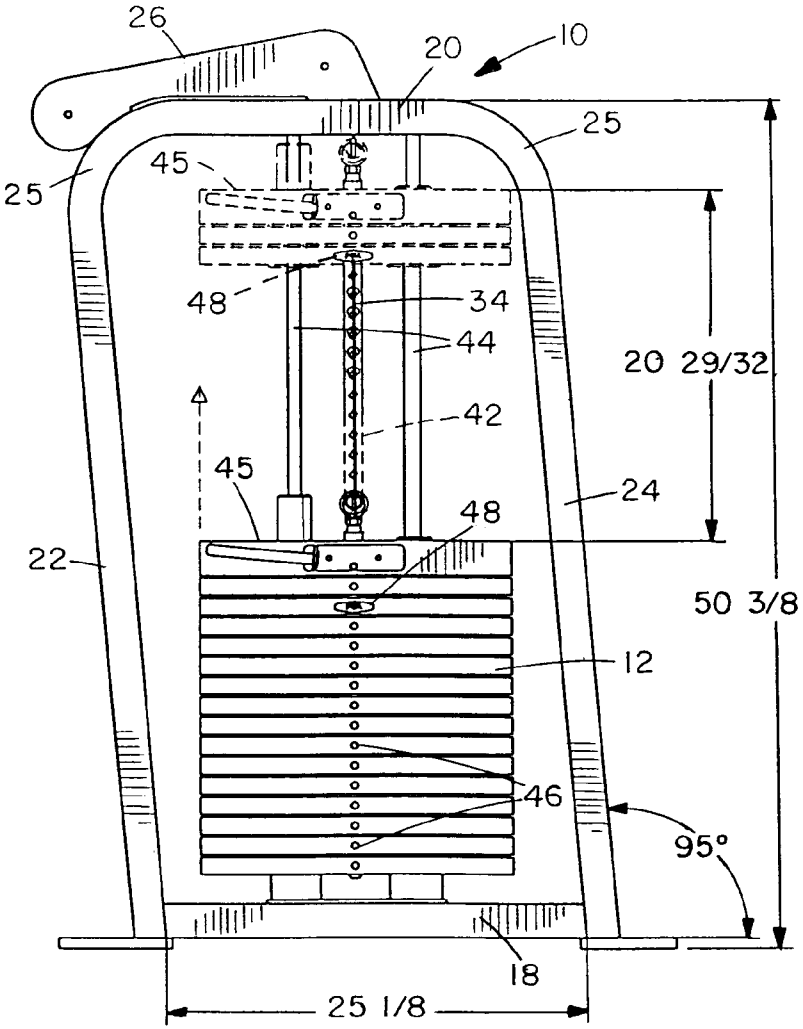
FIG. 11 is a side elevational view of the weight stack support frame of FIG. 3, but including the weight stack, pinning area and guide rods.

FIG. 3 illustrates a weight stack support frame 10 according to a first embodiment of the present invention, while FIG. 11 illustrates the frame 10 with a weight stack 12 mounted in the frame for movement up and down in the frame along guide rods 44. FIGS. 1 and 2 illustrate the frame 10 installed in a bicep curl exercise machine 16. It will be understood that the frame may alternatively be used with other types of exercise devices.

As best illustrated in FIG. 3, the support frame 10 basically comprises a lower horizontal strut 18, an upper horizontal strut 20, and front and rear struts 22,24 extending between the lower and upper struts. The front and rear struts 22,24 are inclined forwardly and parallel to one another. In this embodiment, struts 22,24 are each inclined at an angle of 5° to the vertical orientation, although other angles of inclination may be used in alternative embodiments.

Preferably, each upright strut 22,24 is joined to the respective end of the top strut 20 via an inwardly extending, smooth curve or bend 25. However, in alternative embodiments, the upright struts may be joined to the upper strut via a corner junction, without providing a smooth bend 25 as in FIGS. 1 to 3 and 11.

An inclined pulley housing 26 is mounted on the upper side of the top strut 20, and extends from a location generally above the center of the weight stack 12 (see FIG. 11) to a location protruding slightly outwardly from the bend 25 at the front end of the strut 20. The pulley housing has a rear end 27, a front end 28, a pair of side walls 30, and a top wall 32, and is open at the front and rear end for entry and exit of a load bearing cable 34. The top wall 32 is inclined downwardly from the rear end to the front end. As illustrated in FIGS. 1 to 3, a first cable guide pulley 36 is rotatably mounted between the side walls 30 via a pin extending through aligned openings 37 at the rear end 27 of the housing. A second cable guide pulley 38 is rotatably mounted between the side walls 30 via a pin extending through aligned openings 40 at the front end 28 of the housing. Due to the downward inclination of the pulley housing, the second pulley 38 is positioned lower than the first pulley 36.

The pulley housing 26 may be formed from one piece of material which is folded to from the top wall 32 and downwardly depending side walls 30. Alternatively, it may be made from three separate metal plates which are welded or bolted together. The top wall may be omitted in some designs and replaced by some alternative means for keeping the belt in place and keeping hands out of the housing.

A weight stack 12 is mounted in the weight stack frame 10 in a conventional manner, as best illustrated in FIGS. 1 and 11. A pair of weight stack guide rods 44 project upwardly from the lower strut 18. Guide rods 44 extend to the upper strut 20. The weight stack 12 comprises a plurality of plates of predetermined weight stacked on top of each other. A central weight stack stem 42 is secured to a top plate 45 in the stack, which in turn is linked to one end of the load-bearing cable 32. The plates have aligned central openings through which the weight stack stem 42 projects, and aligned guide openings, one on each side of the central opening, which engage over the respective guide rods 44. Each plate has a side opening 46 aligned with a corresponding opening in the selector stem 42, and a selector pin 48 is inserted through the opening 46 in a selected plate into the stem 42 to determine how many plates will be lifted together with the top plate by the exerciser. A safety shield or plate 49 extends between the front and rear struts 22,24 on the outside of the weight stack frame in order to protect individuals from accidentally coming into contact with the weights.

As best illustrated in FIGS. 1 and 2, the weight stack frame 10 is designed to be positioned in an offset position to one side of an exercise frame 50 and seat 52. In the embodiment of FIGS. 1 and 2, the exercise machine is for performing bicep curl exercises, and includes an exercise arm 54 with a handle 55 for gripping by a user while performing bicep curls. A support 58 is provided for the user to rest their elbow while performing the exercise, as is conventional. A cam or load transfer device 60 is rotatably mounted on the front strut 22 of the weight stack support frame via pivot shaft or axle 62 which is rotatably mounted on support 63 (see FIG. 4). Exercise arm 54 is mounted on the opposite end of pivot shaft 62, as best illustrated in FIG. 1. The load bearing cable 34 extends up from the weight stack, through an opening provided in upper strut 20, and then around the first pulley 36 and the second pulley 38 in pulley housing 26. The cable 34 then extends downwardly from pulley 38 and wraps around cam 60, to which it is secured. Thus, upward rotation of exercise arm 54 will cause rotation of cam 60, pulling the cable 34 and attached weights upwardly, towards the upper position shown in dotted outline in FIG. 11.

One advantage to the forwardly inclined weight stack frame 10 of FIGS. 1 to 4 is that the cam or load transfer device 60 can be mounted in the most advantageous position relative to the exercise seat 52 or user position. The inclined frame positions a front mounted cam further away from the center of the weight stack than it would be if the front strut was vertical. However, with a 5° angle, the user can still be positioned close to the center of the weight stack, or the pinning position, so that they can easily adjust the amount of weight to be lifted without having to leave the seat 52.

When a user is seated and leaning forward to form an exercise, such as a bicep curl exercise, the center of the weight stack or the pinning position should preferably be slightly behind the user. This position is achieved by means of the forwardly inclined weight stack frame of this invention. This positioning is optimum for ease of reaching and adjusting the weights. When leaning forward, it is easier and more natural for the arm to reach backward to adjust the weights.

Another benefit of the forwardly inclined frame 10 is the ability to mount the cam closer to the frame while still being properly positioned to receive cable 34. The closer the cam can be mounted to the frame, the less stress will be placed on the cam mount or support, such as support 63 in the embodiment of FIGS. 1 to 4. The less stress placed on the cam mount, the less structural support needed for the cam. This will reduce both the size of the footprint or floor area needed to support the machine, as well as the manufacturing cost.

Although the weight stack support frame in FIGS. 1 to 4 is used in conjunction with a forward mounted cam and a bicep curl exercise arm, it may alternatively be used with other types of exercise devices requiring both forward and rearward mounted cams, and upper and lower body exercises requiring cam positioning at different heights on the frame. Some of these alternative cam mounts and exercise devices are described below in connection with FIGS. 5 to 10. Correct cam positioning for both front and rear mounted cams can be achieved with this frame without requiring reversing of the frame. In other words, the inclined frame is always positioned leaning forward. This is a manufacturing advantage in that one welding jig or fixture can be used to produce multiple machines and an aesthetic advantage when multiple machines are placed in a row, such as in health clubs. In such a situation, all the frames will angle in the same direction with the weight stack on the same side, producing a much tidier and more pleasing overall appearance.

Figure 4:
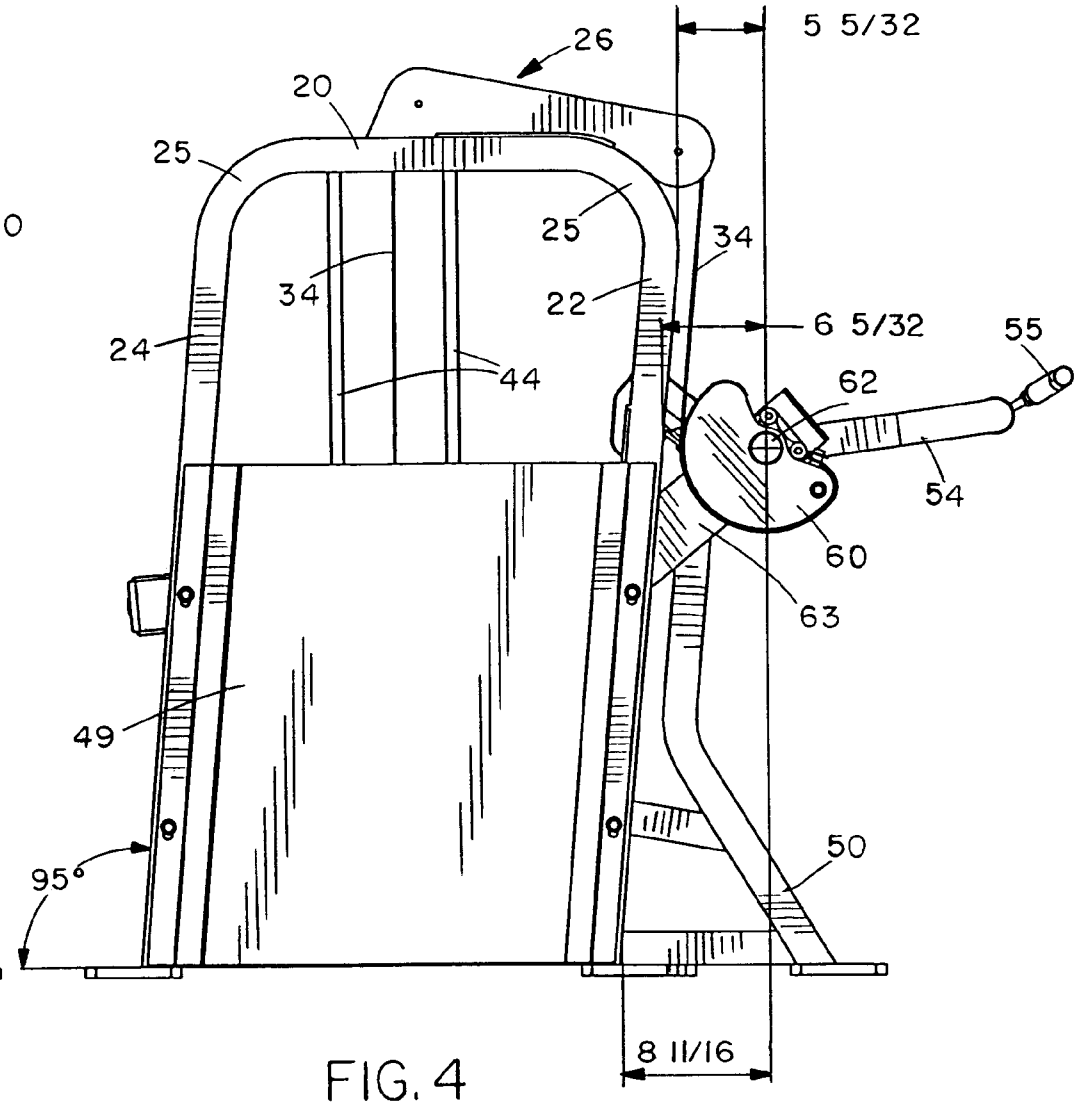
FIG. 4 is a left hand side view of the exercise machine of FIG. 1.

The mounting of the pulley housing 26 on the top of the top strut 20 of the weight stack frame also has advantages. The pulley housing 26 may alternatively be used in conjunction with a straight weight stack frame in which the upright struts do not bend inwardly to meet the top strut, or other weight stack frames which do not incline forwardly. However, when used with the forwardly inclined frame of FIGS. 1 to 4 where the uprights 22,24 do bend smoothly inwardly to meet the upper strut, the housing 26 has a number of advantages. The housing design, in which the housing angles downward towards the front end of the frame, allows the second pulley 38 to rest in the radius of the bend 25, as best illustrated in FIGS. 3 and 4. This keeps the cable 32 as close as possible to both the top strut and forward strut of the frame, as indicated in FIG. 4. The top strut therefore provides the maximum possible structural support for the pulley housing, since the housing does not have to protrude outwardly from the weight frame and the pulley does not have to be suspended in mid-air in order to put the cable in the required position to feed onto cam 60. Safety is therefore improved, since the closer the belt or cable 32 runs to the frame, the less likely it is that it will come into contact with either the user or a bystander. This is extremely important in unsupervised situations.

Another advantage to the pulley housing is that it provides a safety barrier between the cable running over the pulleys and an exerciser or bystander. Additionally, it acts as a guard to prevent the cable from jumping off the pulleys through jerking or sudden movement of the exercise arm.

By mounting the pulley housing on top of the top strut, the cable running over the top of the pulleys will impart a downward force to the pulleys and thus to the housing, which is transferred downwardly onto the frame. Thus, the force will not apply any stress to the welds securing the housing on the top strut.

Figure 5:
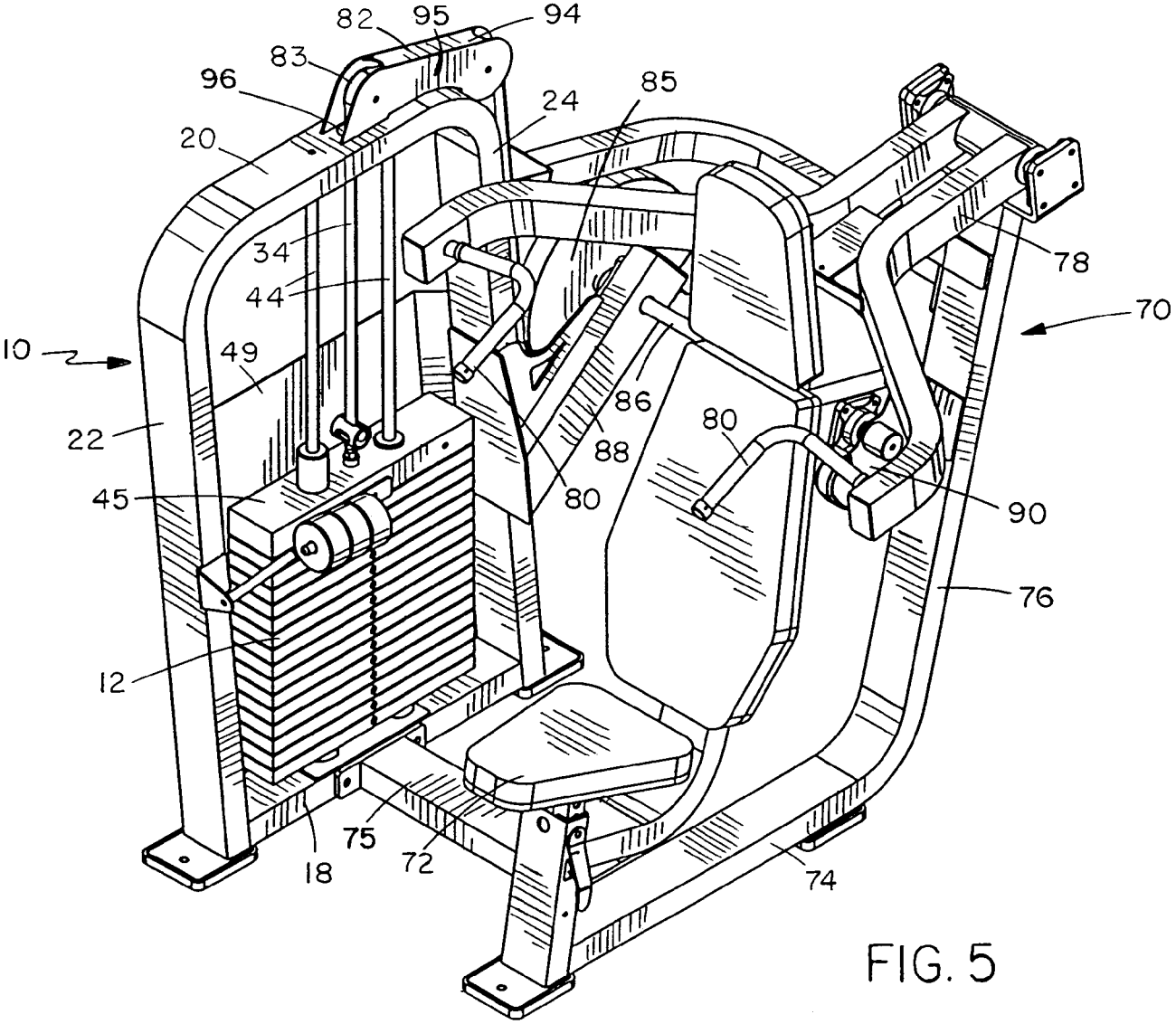
FIG. 5 is a front perspective view of a shoulder press exercise machine incorporating a weight stack frame according to a second embodiment of the present invention.
Figure 6:
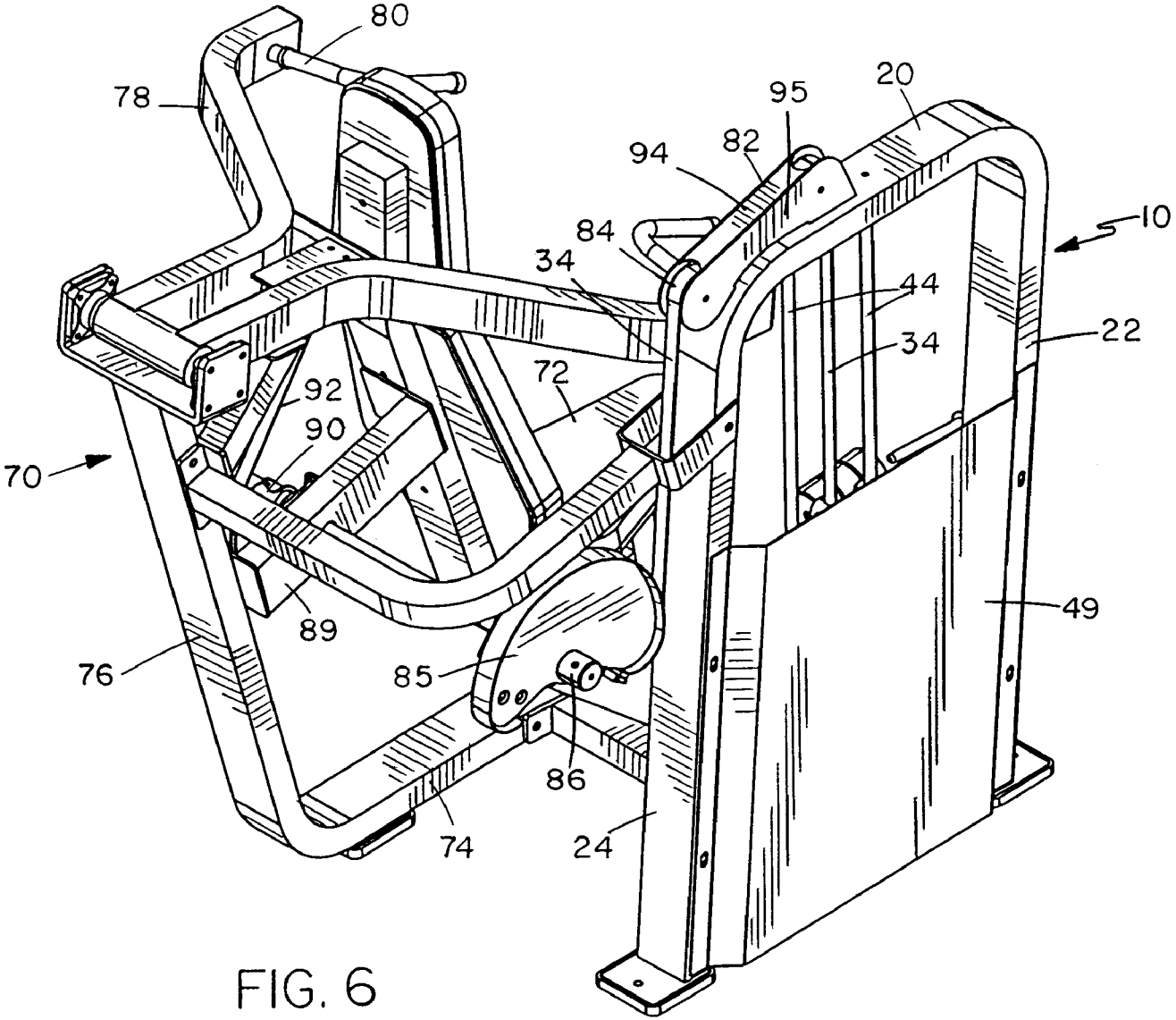
FIG. 6 is a rear perspective view of the machine of FIG. 5.
Figure 9:
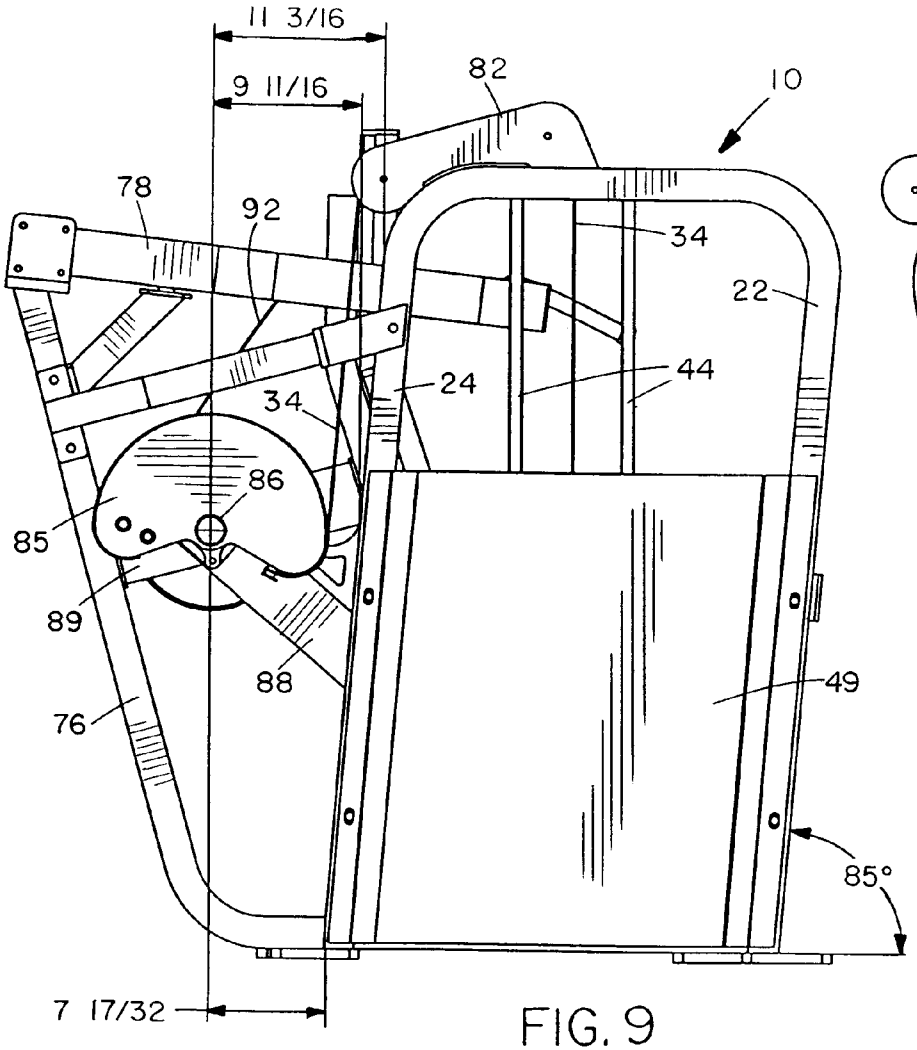
FIG. 9 is a side elevational view of the shoulder press machine of FIGS. 5 and 6.

FIGS. 5, 6 and 9 illustrate the same weight stack support frame 10 of FIGS. 1 to 4 but used in a shoulder press exercise machine 70, and like reference numerals have been used for like parts as appropriate. In the embodiment of FIGS. 5 and 6, a seat 72 for an exerciser is mounted on a support frame 74 which is secured to one side of the weight stack frame 10 via connecting strut 75. Frame 74 has an upwardly extending, rearwardly inclined strut 76 behind seat 72, and a shoulder press exercise arm 78 is pivotally mounted at the upper end of strut 76. Arm 78 has handles 80 positioned in front of the seat at a suitable location for gripping by a user while performing shoulder press exercises.

Unlike the previous embodiment, the exercise load in this embodiment is transferred to the exercise arm 78 from the rear of the frame. Thus, a pulley housing 82 is mounted on the top strut 20 so as to extend to the rear of the frame 10, for housing first and second guide pulleys 83,84 which guide the load bearing cable 34 from the weight stack 12 towards the rear of the frame. A first cam or load transfer device 85 is pivotally mounted at a location adjacent rear upright 24 by means of a pivot shaft or axle 86 which extends through an opening in mount or support plate 88 secured to the rear strut 24, as best illustrated in FIG. 5. The pivot shaft 86 extends through an opening in a second mounting strut 89 projecting from the rear of seat 72, as indicated in FIG. 6, and a second cam 90 is secured to the second end of shaft 86. The load bearing cable 34 extends downwardly from pulley 84 and wraps around the first cam 85, to which it is secured. A second cable 92 extends from the second cam 90 to link the cam assembly to the exercise arm 78, as indicated in FIG. 6 and 9. Thus, anti-clockwise rotation of arm 78 will pull cable 92 upwardly, rotating the cam 90 and thus also rotating shaft 86 and the first cam 85 in a direction to pull downwardly on cable 34 and lift the selected number of weights.

As in the previous embodiment, the pulley housing 82 is inclined downwardly from the first pulley to the second pulley, so that the second pulley is located in the bend or curve 25 joining the rear strut 24 to the top strut 20. Pulley housing 82 has a downwardly inclined top wall 94 and spaced side walls 95 enclosing the two pulleys, and is positioned on top of top strut 20 at a location such that cable 34 projects directly upwardly through an opening 96 in the top strut 20 for engagement over the first pulley 83, as best illustrated in FIG. 5. The cable then extends through the housing, over the second pulley 38, and downwardly in front of the rear strut 24 to secure to the first cam 85.

Figure 8:
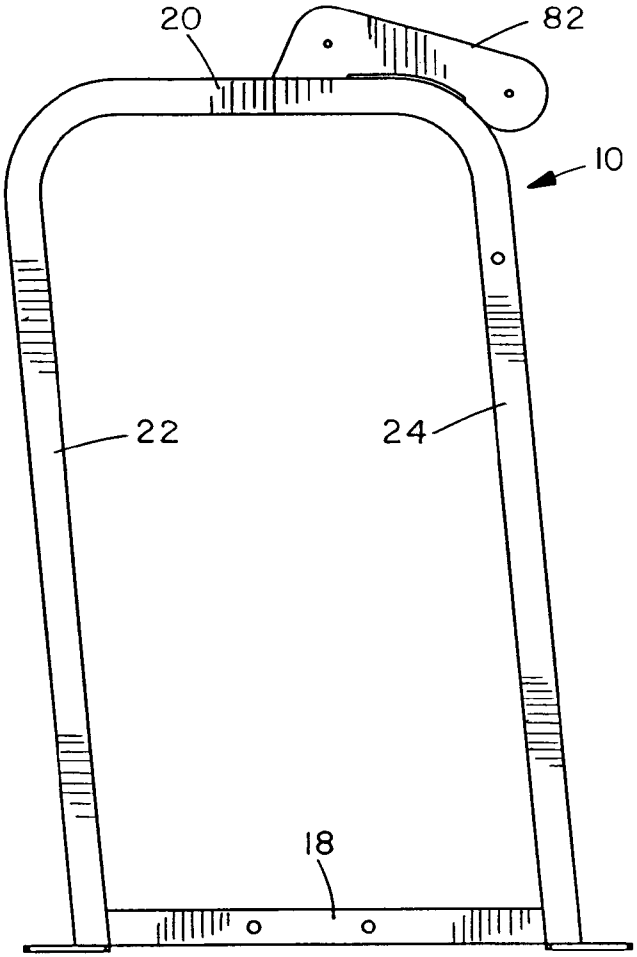
FIG. 8 is a side view of the weight stack support frame used in the machine of FIGS. 5 and 6.

FIG. 8 is a view similar to that of FIG. 3, illustrating the forwardly inclined weight stack frame 10 alone, but with a pulley housing 82 extending to the rear of the housing rather than the forwardly mounted pulley housing 26 of FIG. 3. In FIG. 8, the weight stack and associated guides and cable have been omitted for clarity. The combined weight stack frame 10 and rearwardly mounted pulley housing 82 will be used in all cases where the exercise arm is mounted in rearward position, such as the shoulder press exercise machine of FIGS. 5, 6 and 9. The weight stack frame 10 of FIG. 3 with the forwardly mounted pulley housing 26 will be used in all cases having a forwardly mounted exercise arm, such as the bicep curl machine of FIGS. 1, 2 and 4, and the leg extension machine of FIG. 7.

In this embodiment, as in the first embodiment, the forwardly inclined design of the weight stack frame enables the cam 85 to be mounted in the most advantageous position. When a cam is mounted on the rearward side of the frame 10, the lower it is positioned on the frame, the further will be its distance from the center of the weight stack, or the pinning position. Generally, upper body exercises such as bicep curls or shoulder presses have a higher cam position than lower body exercises such as leg extensions.

When an exerciser is leaning backward performing an exercise such as a shoulder press, as is the case with the exercise machine 70 of FIGS. 5 and 6, the pinning position should be slightly forward of the user. This positioning is optimum for ease of reaching and adjusting the weights. When an exerciser is leaning backwards in seat 72, it is easier to move the arm forward to adjust the weights. The inclined weight stack frame ensures that the pinning position is located slightly forwardly of a user seated in seat 72 in the appropriate position for performing shoulder press exercises.

As in the previous embodiment, the location and design of the pulley housing 82 in this embodiment ensures that the cable 34 is shielded as it travels over the pulleys, and is also guided as close to the frame as possible when traveling from the second pulley 84 down to cam 85. This will have the same advantages as the pulley housing 26 of FIGS. 1 to 4.

Figure 7:
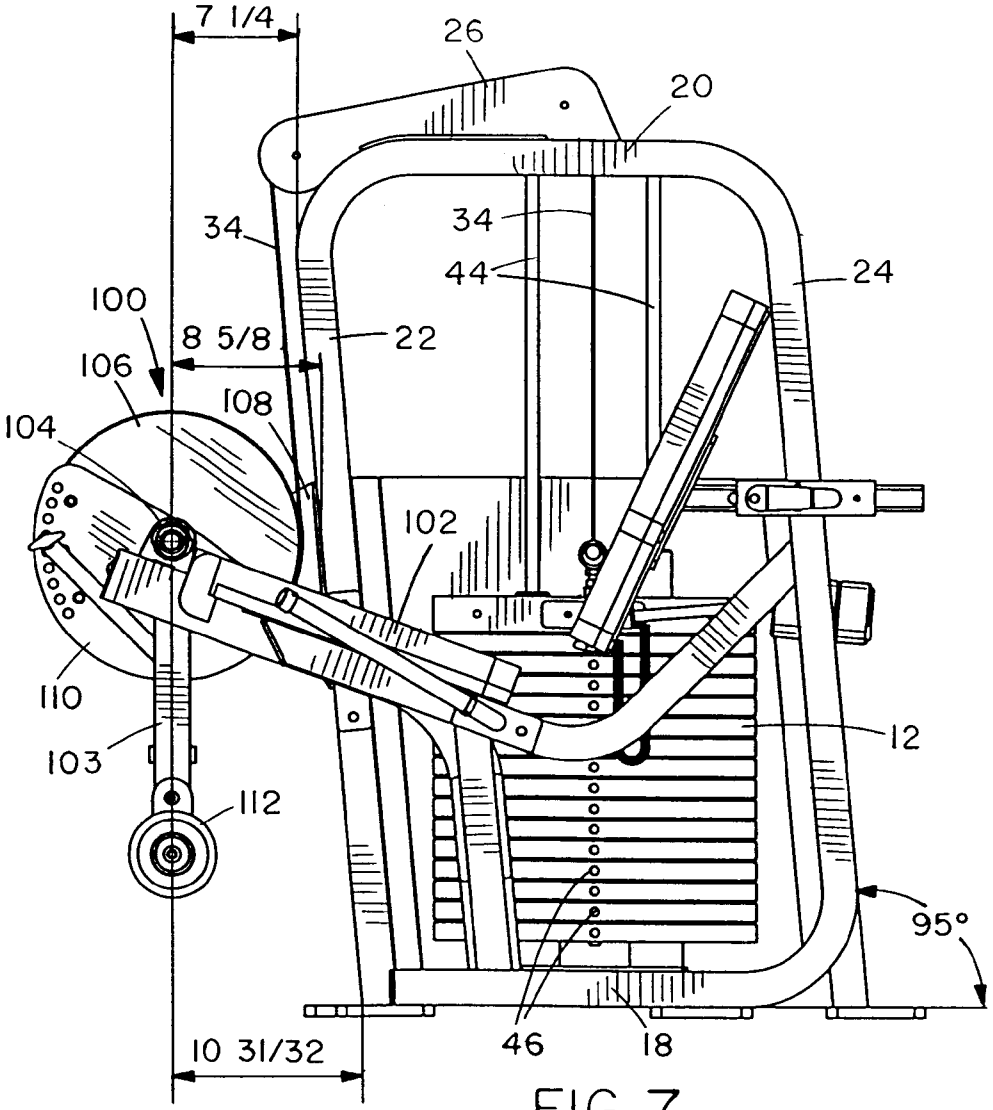
FIG. 7 is a side view of a leg extension exercise machine incorporating the weight stack support frame of FIG. 3.

FIG. 7 illustrates the forwardly inclined weight stack housing 10 of FIGS. 1 to 6 in conjunction with a different type of exercise apparatus, and like reference numerals have been used for like parts as appropriate. The exercise machine 100 of FIG. 7 is designed for performing leg extensions, and the exercise load is taken from the front end of frame 10, as in the first embodiment of FIGS. 1 to 4. In this embodiment, a seat 102 for an exerciser performing leg extensions is again mounted to one side of the frame 10, at a location such that the center or pinning area of the weight stack 12 will be located generally in line with the seated user. A leg extension arm 103 is pivotally mounted at the forward end of seat 102 in a known manner. Pivot shaft 104 is secured to the arm 103 at one end, and to a load transfer cam 106 at the opposite end. Cam 106 and pivot shaft 104 are rotatably mounted in front of the forward strut 22 of frame 10 via a suitable support 108. Cable 34 extends directly downwardly from the second pulley 38 in the front end of housing 26 to the cam 106, to which it is secured. A range of motion device 110 controls the starting position of leg extension arm 103. An exerciser seated in seat 102 will engage the roller pad 112 at the lower end of arm 103 and rotate arm 103 upwardly to rotate in a clockwise direction. This in turn rotates cam 106, pulling down on the end of cable 34 and lifting the selected number of weights.

As in the first embodiment, the cam 106 of this embodiment can be mounted in the optimum position in front of frame 10, and positioned such that the user is seated in a convenient position for adjusting the pinning position on the weight stack 12. At the same time, the cable 34 is protected and is arranged to run as close as possible to the frame, as in both previous embodiments.

Figure 10:
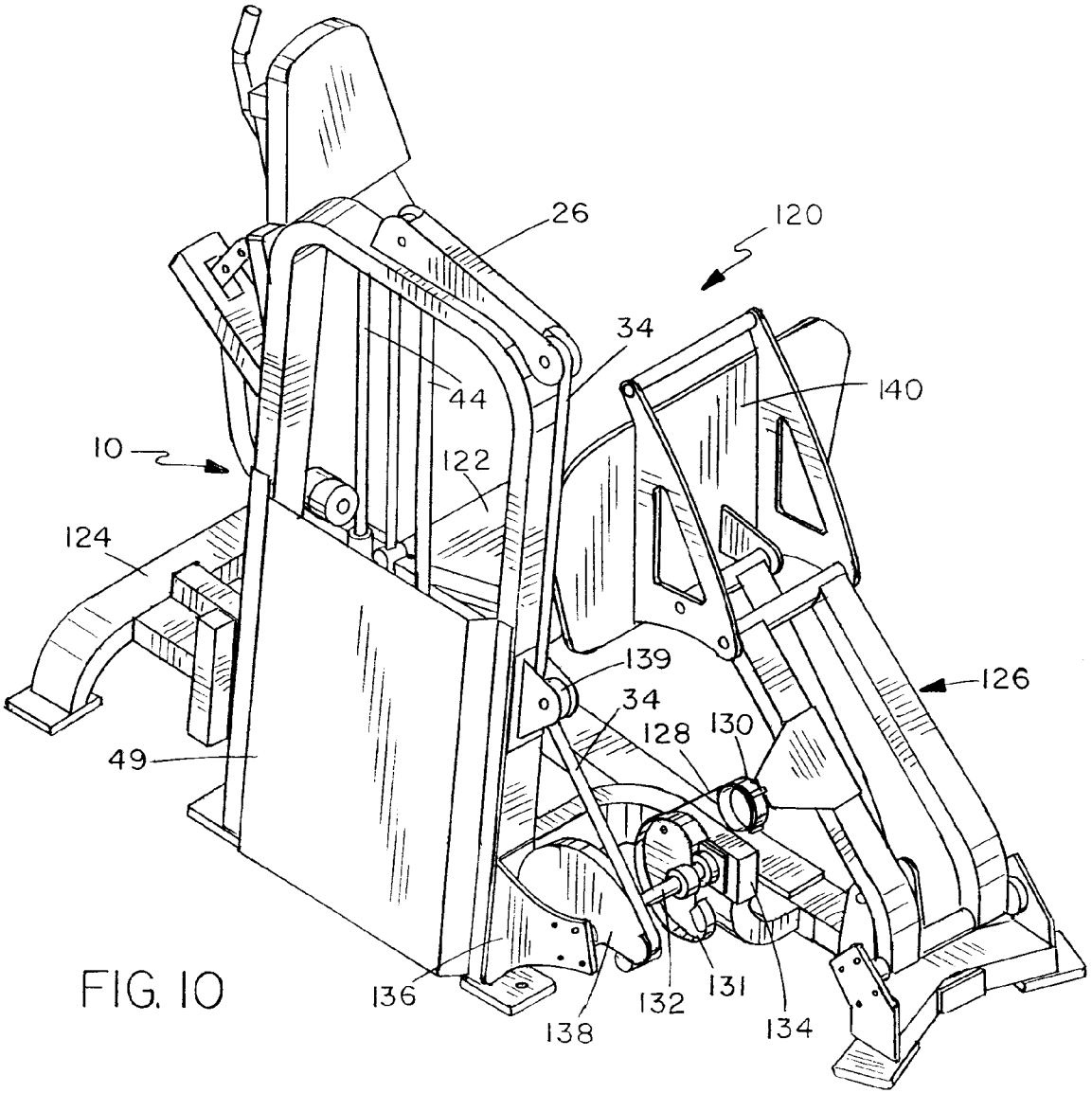
FIG. 10 is a front perspective view of a leg press machine incorporating the weight stack support frame of FIG. 3.

FIG. 10 illustrates a leg press exercise machine 120 incorporating the forwardly inclined weight stack frame 10 of FIG. 3 with a forward mounted pulley housing 26, and like reference numerals have been used for like parts as appropriate. In this embodiment, a rearwardly inclined seat 122 is positioned on a support frame 124 secured to one side of the weight stack frame 10 and weight stack 12. A conventional exercise assembly 126 for performing leg press exercises is pivotally mounted on the frame 124 in front of seat 122. A cable 128 links a pulley 130 on the leg exercise assembly to a first cam 131 at one end of a pivot shaft 132 rotatably mounted between support 134 and 136, with support 136 projecting forwardly from a location adjacent the lower end of the front strut 22 of the frame 10. Load transfer cam 138 is mounted on the opposite end of shaft 132.

The cable or belt 34 extends through pulley housing 26 and downwardly from housing 26 around a guide pulley 139 on front strut 22, and then is directed onto the cam 138. Thus, as the user pushes against a push plate 140 of the exercise assembly 126 with their feet, cable 128 is pulled in a forwards direction, rotating shaft 132 and cam 138 in a clockwise direction, wrapping the belt 34 around the cam and pulling down on the belt so as to lift the selected weights. The arrangement is such that the belt 34 runs as close as possible to the front strut 22, reducing the risk of the exerciser or others accidentally coming into contact with the belt and potentially being injured.

Figure 13:
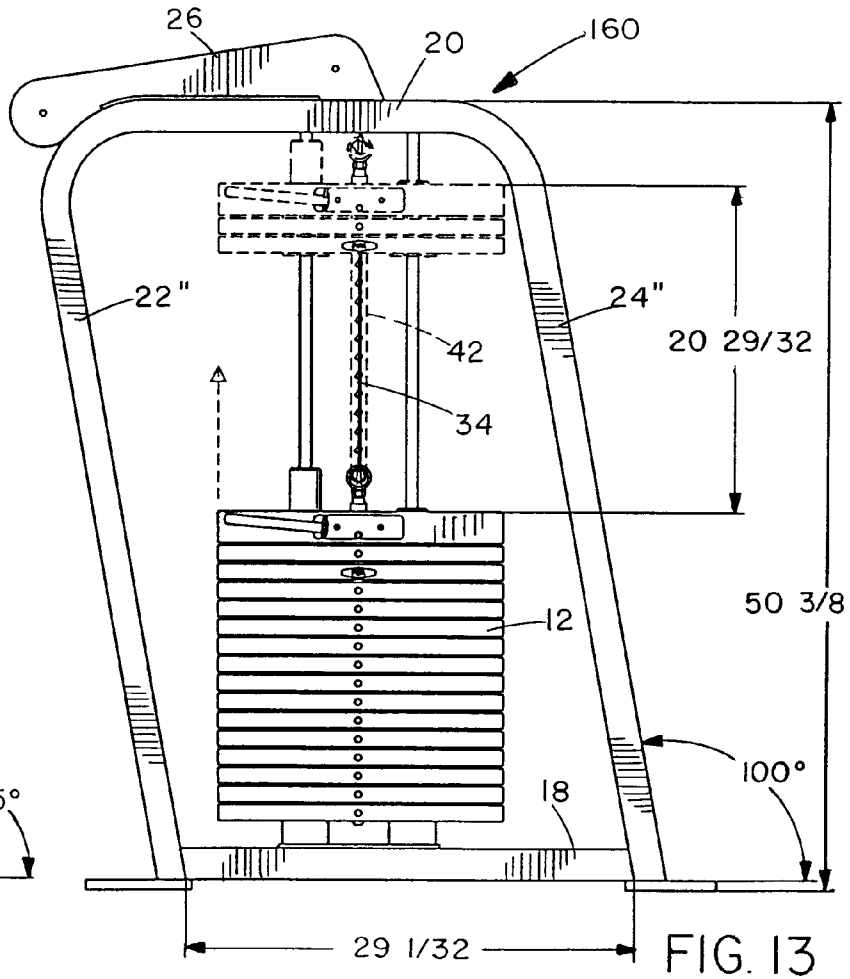
FIG. 13 is a side elevational view similar to FIG. 12 illustrating another modified support frame with increased weight stack travel.
Figure 12:
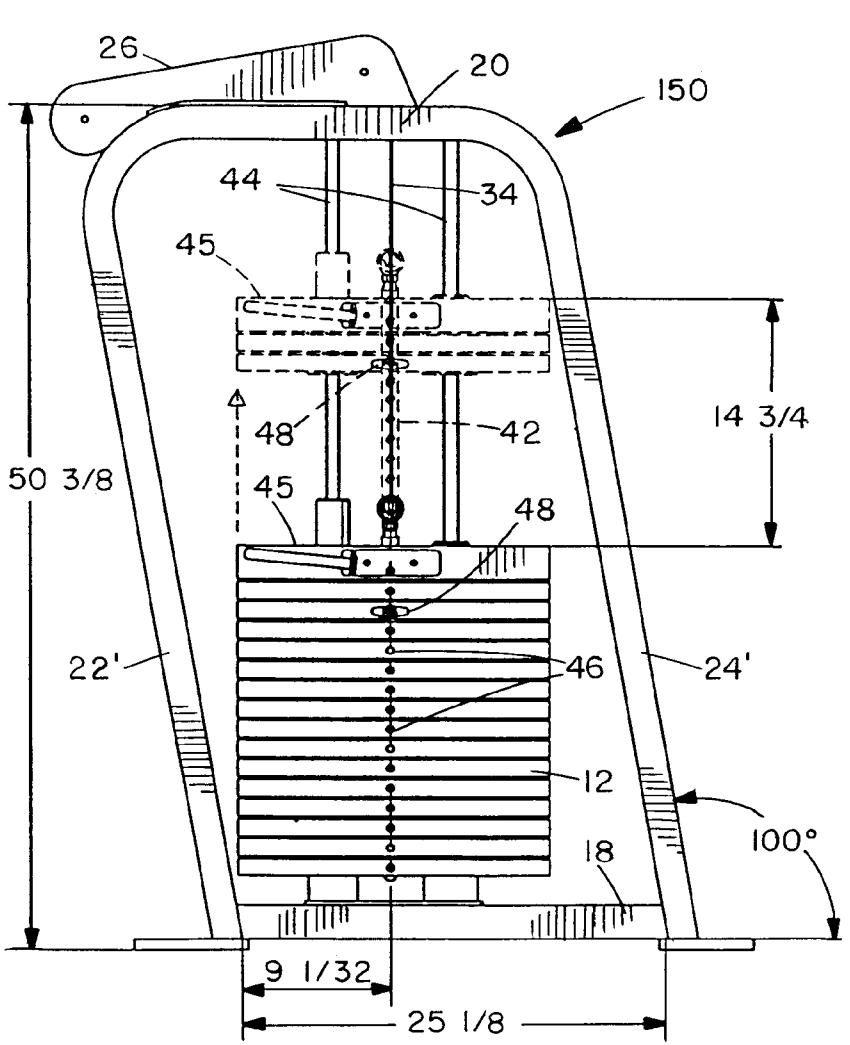
FIG. 12 is a side elevational view similar to FIG. 11 illustrating a modified support frame.

In each of the embodiments described above, the weight stack frame is inclined forwardly at an angle of approximately 5 degrees to the vertical orientation, or 95 degrees to the horizontal or ground surface on which the machine is placed. FIGS. 12 and 13 illustrate two alternative weight stack frames 150,160, respectively, in which the frame is inclined forwardly at an increased angle of about 10 degrees to the vertical orientation. The frame 150 of FIG. 12 is identical to that of FIG. 11, apart from the increased angle of inclination of the front and rear struts 22' and 24', respectively, and like reference numerals have been used for like parts, as appropriate. Although the frame 150 of FIG. 12 is shown with a forward pulley housing 26, it may alternatively be provided with a rearward pulley housing as in FIG. 8 for use in exercise machines where the load is taken from the rear.

As indicated in FIGS. 11 and 12, the overall dimensions and footprint of the weight stack frame of FIG. 12 are the same as that of FIG. 11. However, due to the increased inclination of the frame, the amount of weight stack travel provided is reduced from about 20.75 inches in FIG. 11, with a 5° inclination of the frame, to around 14.75 inches when the frame is inclined at 10°, as in FIG. 12. This is because the rear upright strut 24' encroaches on the weight stack travel, preventing the weight stack from moving up to the top of the frame. It can be seen that the weight stack 12 has been moved towards the front strut 22' in FIG. 12, from its central position in FIG. 11, in order to permit more travel of the weight stack, but still only permits a travel of 14.75 inches with the frame width of 25⅛ inches as illustrated.

The weight stack frame 160 of FIG. 13 is similar to that of FIG. 12, but is of increased width between the front strut 22" and rear strut 24" in order to permit increased weight stack travel. Apart from the increased width and weight stack travel of the frame in FIG. 13, it is otherwise similar to that of FIG. 12, and like reference numerals have been used for like parts as appropriate. The width of the frame 160 of FIG. 13 is about 4 inches greater than that of FIGS. 11 and 12. Both the front and rear struts 22" and 24" are located further away from the weight stack in FIG. 13 than in FIG. 12, and the weight stack has a full range of travel equivalent to that of FIG. 11, although the footprint is slightly larger. The frame 160 of FIG. 13 has front and rear struts which are spaced further from the centerline of the weight stack, so that a cam secured to the front or rear strut will also be positioned further from this centerline. Thus, the seat/user position will also be further from the weight stack centerline in FIG. 13, further increasing the footprint of the machine. Thus, a frame inclination of greater than 10 degrees would not be desirable, and the inclination is preferably in the range from 5° to 10°. A frame angle of 5° is optimum since it provides enough forward lean to put the cam in an advantageous position while keeping the weight pinning area reachable from the user's position and producing the smallest possible footprint.

The frame in the above embodiments is preferably made from a single bent piece of metal tubing, such as 2" by 4" steel tubing, although other sizes and materials may be used to form the frame. The frame may have mitered or welded corners, instead of the bent corners 25 as illustrated in the drawings. Additionally, instead of a single frame, two matching frames may run side-by-side and suitably secured together for added strength. The frames may be formed from elongate members such as metal tubing of identical dimensions, or the members forming the two frames may be of different sizes.

The actual dimensions of the frame will be dependent on the size of the weight stack. The dimensions indicated in FIGS. 11 to 13 are for a weight stack of 20 lb. plates measuring 18½" in length. Some weight stacks use 10 lb. weight plates which are around 10" long, and the frame dimensions for such a weight stack will be proportionately smaller.

Although in the illustrated, preferred embodiments, the upper and lower struts are parallel and horizontal, they need not be parallel in some alternatives. Additionally, although it is preferred that the upright struts are both inclined and parallel to one another, they need not be parallel as long as both are inclined in a forwards direction.

An angled, forwardly inclined frame with parallel upright struts generally will have a smaller footprint, and thus require less floor space, than equivalent frames with vertical struts or A-frames. A frame with a 5° angle provides enough forward lean to put the cam in an advantageous position, keeps the weight pinning area in an easily accessible position reachable by the seated user, and at the same time maintains a maximum amount of weight stack travel. The inclined frame also permits the belt or cable to be routed closer to the frame than in the past, reducing the risk of someone accidentally coming into contact with the cable and potentially being injured.

The provision of an angled pulley housing on top of the top strut of a weight stack frame for housing two cable guide pulleys places the second pulley above the cam in an optimum position for directing the cable downwardly onto the cam. By placing both the pulley outlet and the cam as close as possible to the frame, the cable can be kept as close as possible to the frame for increased safety and improved aesthetic appearance.

Although some preferred embodiments of the invention have been described above by way of example only, it will be understood by those skilled in the field that modifications may be made to the disclosed embodiments without departing from the scope of the invention, which is defined by the appended claims.

We claim:

1. A weight stack frame for supporting the weight stack of an exercise machine, comprising:

spaced upper and lower struts each having opposite front and rear ends; and front and rear upright struts extending between the front ends and the rear ends, respectively, of the upper and lower struts to form an enclosed frame, each upright strut having an upper end joining the respective end of the upper strut to form non-perpendicular angles in a plane defined by the upper, front and rear struts, and a lower end joining the respective ends of the lower strut to form non-perpendicular angles, and the upright struts being parallel to one another.

2. The frame as claimed in claim 1, wherein the upper and lower strut are straight, horizontal members and extend parallel to one another, and the upper, lower, front and rear struts are co-planar, whereby the frame forms a parallelogram shape with non-perpendicular angles.

3. The frame as claimed in claim 1, including a cam mounted on one of the upright struts for transferring load to an exercise arm.

4. The frame as claimed in claim 1, wherein one of said predetermined angles at one end of said upper strut is approximately 95 degrees and the other predetermined angle at the opposite end of said upper strut is approximately 85 degrees.

5. The frame as claimed in claim 1, wherein one of said predetermined angles at one end of said upper strut is between 95 and 100 degrees and the other predetermined angle at the opposite end of said strut is between 85 and 80 degrees.

6. The frame as claimed in claim 1, wherein the upper strut and upright struts are formed integrally from a single elongate member bent to form a generally U-shaped, inclined structure having smoothly curving corners connecting each end of the upper strut to the respective front and rear strut.

7. The frame as claimed in claim 1, including a pulley housing mounted on the upper strut for enclosing pulleys for guiding a load-carrying belt or cable to the front or rear of the frame.

8. The frame as claimed in claim 1, wherein the lower strut includes a base portion for engaging a ground surface and maintaining the frame in a fixed, generally upright orientation, and support means for supporting a weight stack in a fixed vertical orientation.

9. A weight stack frame for supporting the weight stack of an exercise machine, comprising:

spaced upper and lower struts each having opposite front and rear ends;

front and rear upright struts extending between the front ends and the rear ends, respectively, of the upper and lower struts to form an enclosed frame, each upright strut being inclined at a predetermined, non-perpendicular angle to the upper and lower struts, and the upright struts being parallel to one another;

a pulley housing mounted on the upper strut for enclosing pulleys for guiding a load-carrying belt or cable to the front or rear of the frame; and the upper strut having a central portion for positioning over a weight stack mounted in the frame to extend between the lower and upper strut, the pulley housing having first and second ends, the first end being located over the central portion of the upper strut and second end being located at one end of the upper strut; and a first pulley located in the first end of the housing, and a second pulley located at the second end of the housing at a position protruding slightly outwardly from the respective upright strut.

10. The frame as claimed in claim 9, wherein the second pulley is at a lower elevation than the first pulley.

11. The frame as claimed in claim 9, wherein the housing has an upper wall above the pulleys and a pair of opposite side walls, each side wall being secured to the upper strut, and the housing further has openings at each end for entry and exit of a load bearing cable into and out of the housing.

12. The frame as claimed in claim 11, wherein the upper wall of the housing is inclined downwardly from the first end to the second end of the housing.

13. The frame as claimed in claim 9, wherein the pulley housing has a lower end secured to the upper strut along at least a major portion of the length of the housing from said first end to a location adjacent said second end.

14. A weight stack frame apparatus for supporting a weight stack and guiding a load bearing cable from the weight stack to an exercise station, the apparatus comprising:

a frame having upper and lower struts and front and rear upright struts extending between the upper and lower struts, the upright struts being parallel and; inclined at a non-perpendicular angle to the upper and lower struts;

a mounting and guide assembly for a weight stack extending between the upper and lower struts;

a weight stack seated on the lower strut and supported on the mounting and guide assembly;

the upper strut having an upper side, a lower side, a front end and a rear end;

a pulley housing mounted on the upper side of the upper strut, the pulley housing having a first end located over the weight stack mounting and guide assembly and a second end adjacent one end of the upper strut;

a first pulley mounted in the first end of the housing;

a second pulley mounted in the second end of the housing;

the pulleys comprising means for guiding a load-bearing cable from the weight stack to the front or rear end of the housing; and the second pulley being at a lower elevation than the first pulley.

15. The apparatus as claimed in claim 14, wherein the upper strut is connected to each upright strut by a smoothly curving corner portion, and the second end of the housing protrudes from the respective end of the upper strut over the curving corner portion.

16. The apparatus as claimed in claim 15, wherein the pulley housing has a base extending from the first end of the housing to a location adjacent the second end of the housing, the base being secured to the upper strut along the entire length of the base, the base being curved adjacent the second end of the housing to match the curvature of the corner portion at the respective end of the upper strut.

17. The apparatus as claimed in claim 14, wherein the upright struts are inclined forwardly.

18. The apparatus as claimed in claim 14, including a cam mounted on the front upright strut, the cam having a cable receiving portion adjacent the front upright strut, the pulley housing extending from said first end to the forward end of the frame and the second pulley having a cable outlet located above the cable receiving portion of the cam.

19. The apparatus as claimed in claim 14, including a cam mounted on the rear upright strut, the cam having a cable receiving portion adjacent the rear upright strut, the pulley housing extending from said first end to the rear end of the frame and the second pulley having a cable outlet located above the cable receiving portion of the cam.

20. The apparatus as claimed in claim 14, wherein the pulley housing has an upper wall and a pair of side walls, each side wall having a lower end secured to the upper strut, and the upper wall extending over said pulleys.

21. The apparatus as claimed in claim 20, wherein the upper wall is inclined downwardly between said first and second ends.

22. The apparatus as claimed in claim 14, wherein the pulley housing has a lower end secured to the upper strut along at least a major portion of the length of the housing from said first end to a location adjacent said second end.

23. An exercise machine comprising:

a first support frame;

a forwardly facing seat for a user mounted on the support frame, the seat having a forward end, a rear end, and opposite sides;

an exercise device pivotally mounted on the support frame for use by a user to perform exercises;

a weight stack support frame positioned to one side of the seat, the frame having a lower strut, an upper strut, and front and rear upright struts extending between the lower and upper struts to form an enclosure, the upper strut, lower strut, front and rear struts being co-planar;

a weight stack mounted in the frame enclosure; and a cable and pulley assembly linking a preselected number of weights in the weight stack to the exercise device;

the front and rear struts of the weight stack frame being parallel and inclined at a non-perpendicular angle to the upper and lower struts.

24. The machine as claimed in claim 23, wherein the upper and lower strut are horizontal and parallel to one another, and the weight stack support frame is vertically oriented, the weight stack having a central axis lying in the plane of the support frame and extending between the lower and upper strut.

25. The machine as claimed in claim 23, including a cam mounted on one of the upright struts at a first end of the weight stack support frame for transferring load to the exercise device, and a cable guide assembly on top of the upper strut, the upper strut having an opening aligned with the center of the weight stack, the cable extending from the weight stack through the opening, over the cable guide assembly to the first end of the weight stack support frame, and downwardly alongside the said one upright strut to the cam, the cam being linked to the exercise device.

26. The machine as claimed in claim 23, wherein one of the upright struts intersects the upper strut at a first predetermined angle of approximately 95 degrees, and the other upright strut intersects the upper strut at a predetermined second angle of approximately 85 degrees.

27. The machine as claimed in claim 23, wherein the first predetermined angle is between 95 degrees and 100 degrees, and the second predetermined angle is between 85 degrees and 80 degrees.

28. The machine as claimed in claim 23, wherein the upper strut and upright struts are formed integrally from a single elongate member bent to form a generally U-shaped, forwardly inclined structure having smoothly curving corners connecting each end of the upper strut to the respective front and rear strut.

29. The machine as claimed in claim 28, including a pulley housing mounted on the upper strut, the housing having a first end positioned over the weight stack and a second end adjacent one end of the frame, and a base extending from the first end to the second end of the housing and secured to the upper strut along the entire length of the base, the base being curved adjacent the second end of the housing to match the curvature at the respective end of the upper strut, the cable and pulley assembly including a first guide pulley mounted in the first end of the housing and a second guide pulley mounted in the second end of the housing.

30. An exercise machine comprising:

a first support frame;

a forwardly facing seat for a user mounted on the support frame, the seat having a forward end, a rear end, and opposite sides;

an exercise device pivotally mounted on the support frame for use by a user to perform exercises;

a weight stack support frame positioned to one side of the seat, the frame having a lower strut, an upper strut, and front and rear upright struts extending between the lower and upper struts to form an enclosure;

a weight stack mounted in the frame enclosure;

a cable and pulley assembly linking a preselected number of weights in the weight stack to the exercise device;

the front and rear struts of the weight stack frame being parallel and inclined at a non-perpendicular angle to the upper and lower struts; and a pulley housing mounted on the upper strut, the housing having a first end positioned over the weight stack and a second end protruding from one end of the weight stack support frame, a first guide pulley mounted in the first end of the housing and a second guide pulley mounted in the second end of the housing, the upper strut having an opening aligned with the first guide pulley, and the cable extending upwardly from the weight stack through said opening, over the first and second guide pulleys, and out of the second end of the housing.

31. The machine as claimed in claim 30, wherein the second pulley is at a lower elevation than the first pulley.

32. The machine as claimed in claim 30, including a cam rotatably mounted on the upright strut at said one end of the weight stack support frame below the second end of said pulley housing, and a pivot shaft linking said cam to the exercise device, the cable extending downwardly from the second end of said housing to said cam.

33. The machine as claimed in claim 30, wherein the housing has an upper wall above the pulleys and a pair of opposite side walls, each side wall being secured to the upper strut.

34. The machine as claimed in claim 33, wherein the upper wall of the housing is inclined downwardly from the first end to the second end of the housing.

35. The machine as claimed in claim 30, wherein the pulley housing has a lower end secured to the upper strut along at least a major portion of the length of the housing from said first end to a location adjacent said second end.

36. A weight stack frame for supporting the weight stack of an exercise machine, comprising:

spaced upper and lower struts each having opposite front and rear ends;

front and rear upright struts extending between the front ends and the rear ends, respectively, of the upper and lower struts to form an enclosed frame, each upright strut being inclined at a predetermined, non-perpendicular angle to the upper and lower struts, and the upright struts being parallel to one another;

the upper strut and upright struts being formed integrally from a single elongate member bent to form a generally U-shaped, inclined structure having smoothly curving corners connecting each end of the upper strut to the respective front and rear strut; and a pulley housing mounted on the upper strut, the housing having a first end positioned over a weight stack mounted in the frame and a second end adjacent one end of the frame, and a base extending from the first end to a location adjacent the second end of the housing, the base being secured to the upper strut along the entire length of the base, the base being curved adjacent the second end of the housing to match the curvature at the respective corner of the frame.

* * * * *